US009070985B2

(12) United States Patent
Wang

(10) Patent No.: US 9,070,985 B2
(45) Date of Patent: Jun. 30, 2015

(54) MOBILE DEVICE AND ANTENNA STRUCTURE THEREIN

(71) Applicant: Acer Incorporated, Taipei Hsien (TW)

(72) Inventor: Chuan-Chun Wang, Taipei Hsien (TW)

(73) Assignee: ACER INCORPORATED, Taipei Hsien (TW)

( * ) Notice: Subject to any disclaimer, the term of this patent is extended or adjusted under 35 U.S.C. 154(b) by 201 days.

(21) Appl. No.: 13/731,287

(22) Filed: Dec. 31, 2012

(65) Prior Publication Data

US 2014/0071005 A1 Mar. 13, 2014

(30) Foreign Application Priority Data

Sep. 7, 2012 (TW) ..... 101132656 A

(51) Int. Cl.
*H01Q 21/28* (2006.01)
*H01Q 1/24* (2006.01)
*H01Q 13/10* (2006.01)

(52) U.S. Cl.
CPC ..... *H01Q 21/28* (2013.01); *H01Q 13/106* (2013.01); *H01Q 1/243* (2013.01)

(58) Field of Classification Search
CPC ..... H01Q 13/10; H01Q 13/106; H01Q 21/28
USPC ..... 343/725, 767, 770, 729
See application file for complete search history.

(56) References Cited

U.S. PATENT DOCUMENTS

| | | | | |
|---|---|---|---|---|
| 4,707,700 | A * | 11/1987 | Nagy | 343/712 |
| 4,873,529 | A * | 10/1989 | Gibson | 343/700 MS |
| 7,006,048 | B2 * | 2/2006 | Chang | 343/767 |
| 2009/0058735 | A1 * | 3/2009 | Hill et al. | 343/702 |
| 2011/0095954 | A1 * | 4/2011 | Sim et al. | 343/767 |
| 2011/0148722 | A1 * | 6/2011 | Bellows | 343/729 |
| 2012/0106770 | A1 * | 5/2012 | Tsai et al. | 381/384 |
| 2012/0162036 | A1 * | 6/2012 | Yanagi et al. | 343/729 |
| 2012/0202444 | A1 * | 8/2012 | Pera et al. | 455/266 |

* cited by examiner

*Primary Examiner* — Robert Karacsony
(74) *Attorney, Agent, or Firm* — McClure, Qualey & Rodack LLP

(57) ABSTRACT

A mobile device includes a metal body element, a feeding element, and a second antenna. The metal body element is substantially a planar structure and has a slot, wherein a first antenna is formed by the slot of the metal body element. The feeding element extends across the slot of the metal body element, and is coupled to a first signal source. The second antenna is substantially located inside the slot of the metal body element, and is coupled to a second signal source. The slot is used as a portion of a resonant structure of the second antenna in order to reduce a total size of the first antenna and the second antenna.

10 Claims, 6 Drawing Sheets

MOBILE DEVICE AND ANTENNA STRUCTURE THEREIN

CROSS REFERENCE TO RELATED APPLICATIONS

This Application claims priority of Taiwan Patent Application No. 101132656 filed on Sep. 7, 2012, the entirety of which is incorporated by reference herein.

BACKGROUND OF THE INVENTION

1. Field of the Invention

The disclosure generally relates to a mobile device, and more particularly, relates to a mobile device comprising an antenna structure.

2. Description of the Related Art

With the progress of mobile communication technology, mobile devices, for example, portable computers, mobile phones, tablet computer, multimedia players, and other hybrid functional portable electronic devices, have become more common To satisfy the demand of users, mobile devices usually can perform wireless communication functions. Some functions cover a large wireless communication area, for example, mobile phones using 2 G, 3 G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area, for example, mobile phones using Wi-Fi, Bluetooth, and WiMAX (Worldwide Interoperability for Microwave Access) systems and using frequency bands of 2.4 GHz, 3.5 GHz, 5.2 GHz, and 5.8 GHz.

Traditionally, a metal element with a fixed size is used as a main body of an antenna. The metal element is one-second wavelength or one-fourth wavelength in length, wherein the wavelength corresponds to the desired frequency band. Generally, an antenna corresponding to a low band (e.g., a GPS (Global Positioning System) band) usually has a large size and cannot be designed in a small mobile device.

BRIEF SUMMARY OF THE INVENTION

In one exemplary embodiment, the disclosure is directed to a mobile device, comprising: a metal body element, being substantially a planar structure, and having a slot, wherein a first antenna is formed by the slot of the metal body element; a feeding element, extending across the slot of the metal body element, and coupled to a first signal source; and a second antenna, substantially located inside the slot of the metal body element, and coupled to a second signal source, wherein the slot is used as a portion of a resonant structure of the second antenna in order to reduce a total size of the first antenna and the second antenna.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures thereof in the invention are shown in detail as follows.

Figure 1A:
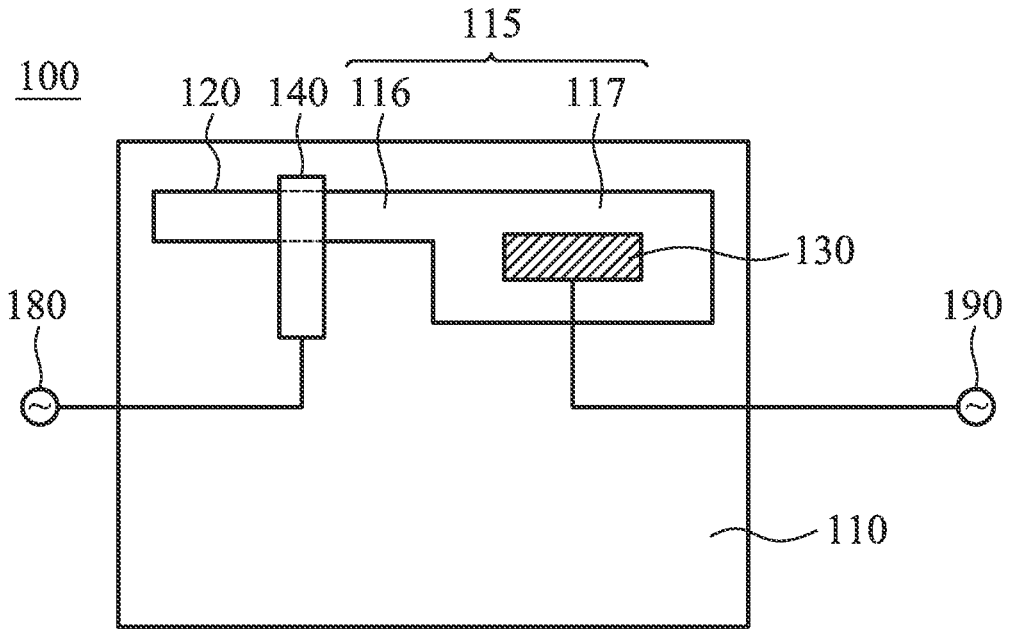
FIG. 1A is a top view for illustrating a mobile device according to an embodiment of the invention.
Figure 1B:
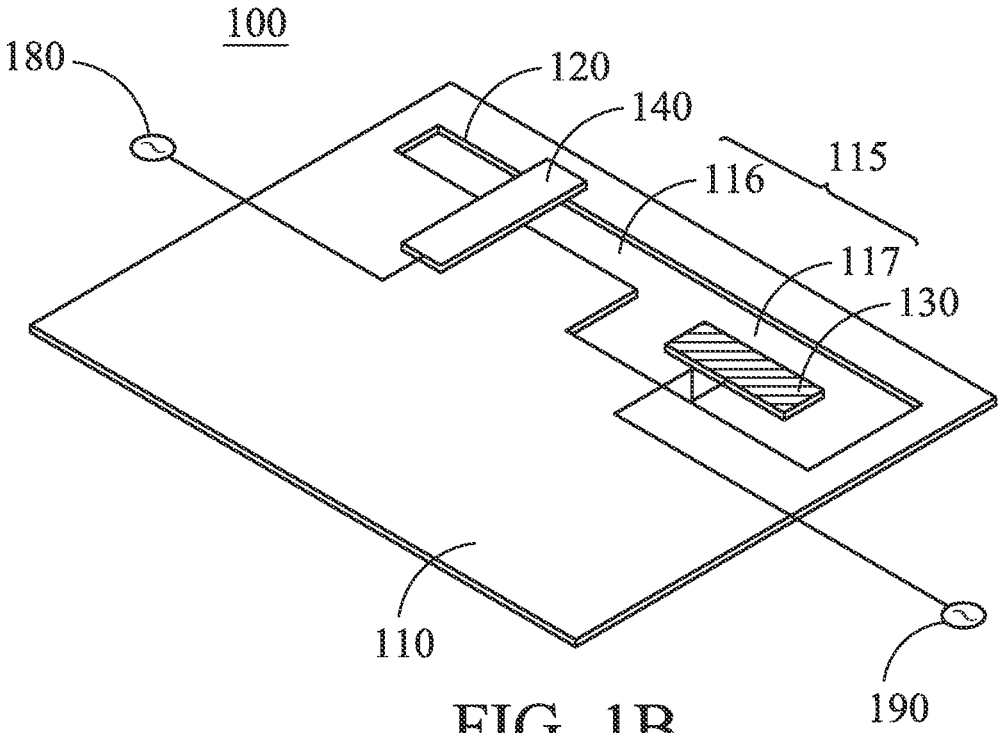
FIG. 1B is a pictorial drawing for illustrating a mobile device according to an embodiment of the invention.

FIG. 1A is a top view for illustrating a mobile device 100 according to an embodiment of the invention. FIG. 1B is a pictorial drawing for illustrating a mobile device 100 according to an embodiment of the invention. The mobile device 100 may be a smart phone, a tablet computer, or a notebook computer. As shown in FIGS. 1A and 1B, the mobile device 100 at least comprises a metal body element 110, a feeding element 140, and a second antenna 130. More particularly, the metal body element 110 is substantially a planar structure and has a slot 115. A first antenna 120 (i.e., a slot antenna) is formed by the slot 115 of the metal body element 110. The type of the second antenna 130 is not restricted, and may be any type of antennas, for example, a monopole antenna, a dipole antenna, a patch antenna, a loop antenna, or a chip antenna.

In an embodiment, the metal body element 110 is a portion of a housing (not shown) of the mobile device 100. In another embodiment, the metal body element 110 is a ground plane, which is disposed on a system circuit board (not shown) of the mobile device 100. Note that the mobile device 100 may further comprise other essential components, for example, a processor, a touch panel, a speaker, and a battery (not shown).

The feeding element 140 extends across the slot 115 of the metal body element 110, and is coupled to a first signal source 180. The feeding element 140 is configured to excite the first antenna 120 (slot antenna). Generally, the feeding element 140 and the metal body element 110 are usually located on different planes. The second antenna 130 is substantially located inside the slot 115 of the metal body element 110, and is coupled to a second signal source 190. In some embodiments, the first antenna 120 is configured to cover a low band, and the second antenna 130 is configured to cover a high band. In the embodiment, the slot 115 of the metal body element 110 substantially has an L-shape. However, the invention is not limited to the above. The slot 115 may have other shapes (e.g., a rectangular shape, an S-shape, or an irregular shape) to improve the impedance matching of the mobile device 100. In some embodiments, the slot 115 comprises a wide portion 117 and a narrow portion 116, and the second antenna 130 is substantially located inside the wide portion 117 of the slot 115.

To be brief, the embodiment uses the environment of an antenna slot (e.g., the slot 115 by which the first antenna 120 is formed) as a portion of a resonant structure of another antenna (e.g., the second antenna 130) to combine the two functional antennas. Accordingly, the size of a mobile device may be further reduced, and the demand for an aesthetic appearance may be satisfied, while improving the performances of the antennas.

Figure 2A:
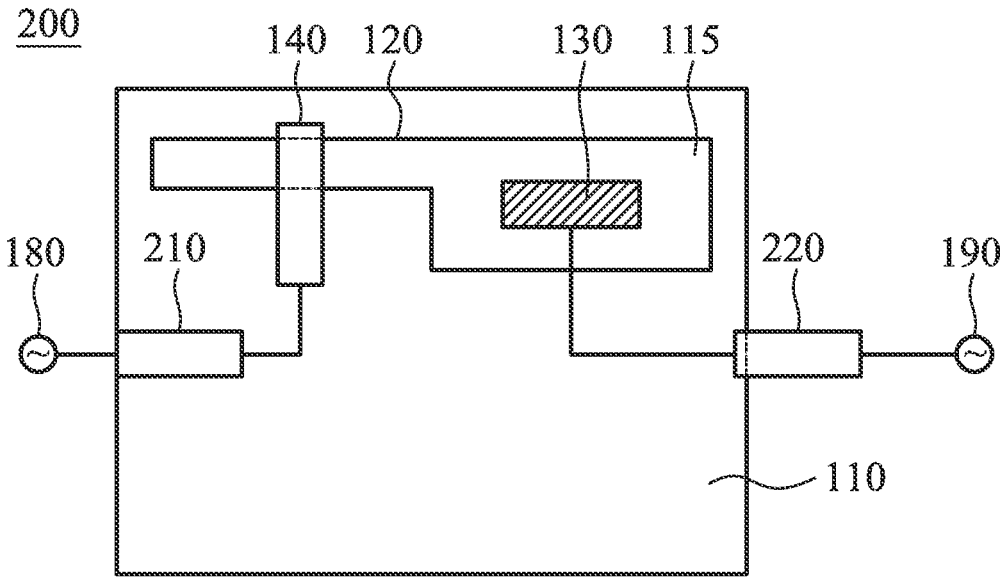
FIG. 2A is a top view for illustrating a mobile device according to an embodiment of the invention.
Figure 2B:
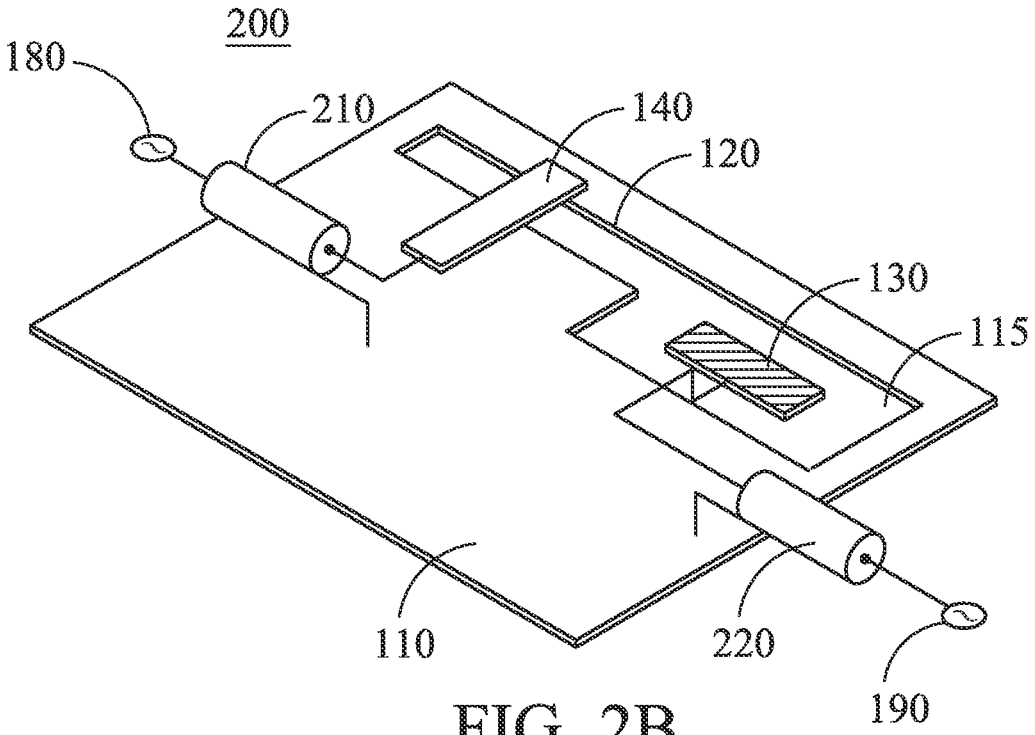
FIG. 2B is a pictorial drawing for illustrating a mobile device according to an embodiment of the invention.

FIG. 2A is a top view for illustrating a mobile device 200 according to an embodiment of the invention. FIG. 2B is a pictorial drawing for illustrating a mobile device 200 according to an embodiment of the invention. The mobile device 200 is similar to the mobile device 100 shown in FIGS. 1A and 1B. In the embodiment, the mobile device 200 further comprises a first coaxial cable 210 and a second coaxial cable 220. The first coaxial cable 210 is coupled between the feeding element 140 and the first signal source 180. The second coaxial cable 220 is coupled between the second antenna 130 and the second signal source 190. Each of the first coaxial cable 210 and the second coaxial cable 220 substantially has a cylindrical shape, and may be bent into other shapes.

Figure 3A:
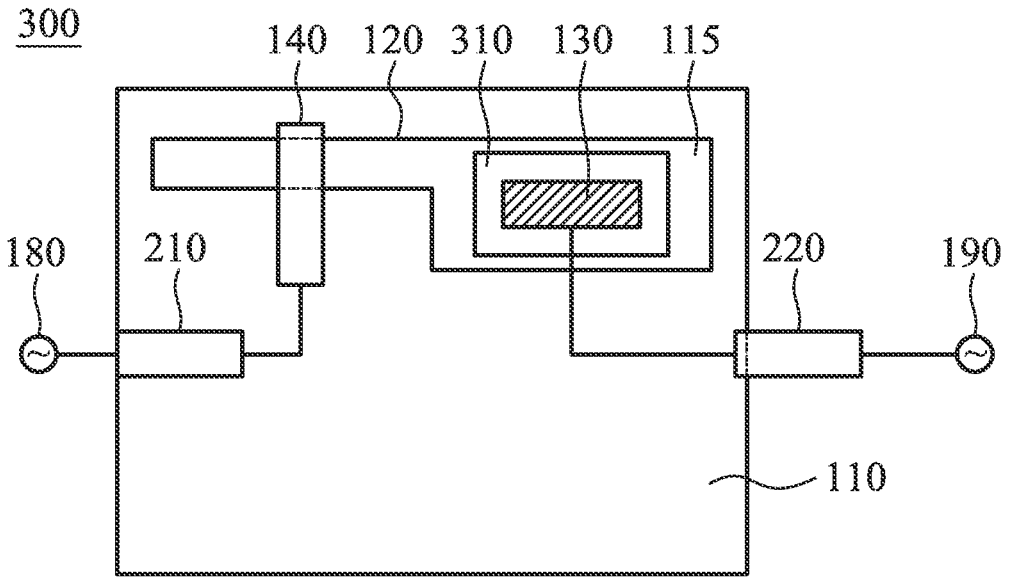
FIG. 3A is a top view for illustrating a mobile device according to an embodiment of the invention.
Figure 3B:
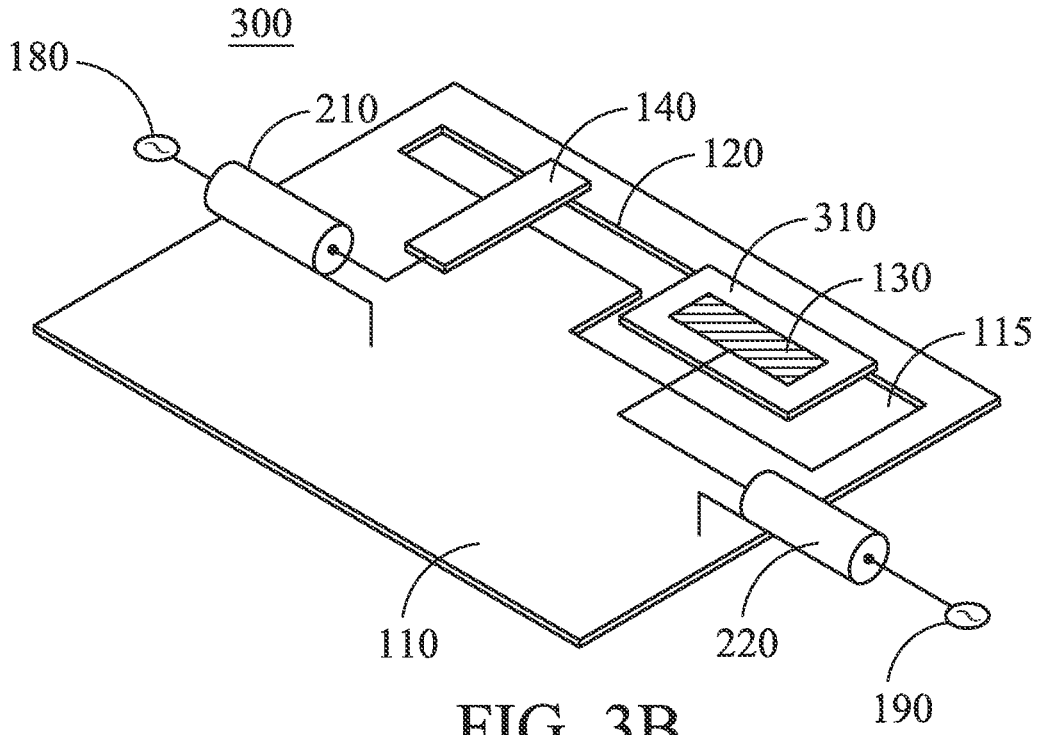
FIG. 3B is a pictorial drawing for illustrating a mobile device according to an embodiment of the invention.

FIG. 3A is a top view for illustrating a mobile device 300 according to an embodiment of the invention. FIG. 3B is a pictorial drawing for illustrating a mobile device 300 according to an embodiment of the invention. The mobile device 300 is similar to the mobile device 100 shown in FIGS. 1A and 1B. In the embodiment, the mobile device 300 further comprises a dielectric substrate 310 (e.g., an FR4 substrate). The second antenna 130 is disposed on the dielectric substrate 310. In some embodiments, the second antenna 130 is a planar printed antenna, which is printed on a surface of the dielectric substrate 310. Note that the dielectric substrate 310 and the metal body element 110 may be located on different planes. If a vertical projection of the second antenna 130 does not overlap any conductive materials (e.g., the vertical projection may be substantially located inside the slot 115), the second antenna 130 should not be affected very much by the metal body element 110, such that good antenna efficiency thereof is maintained.

Figure 4A:
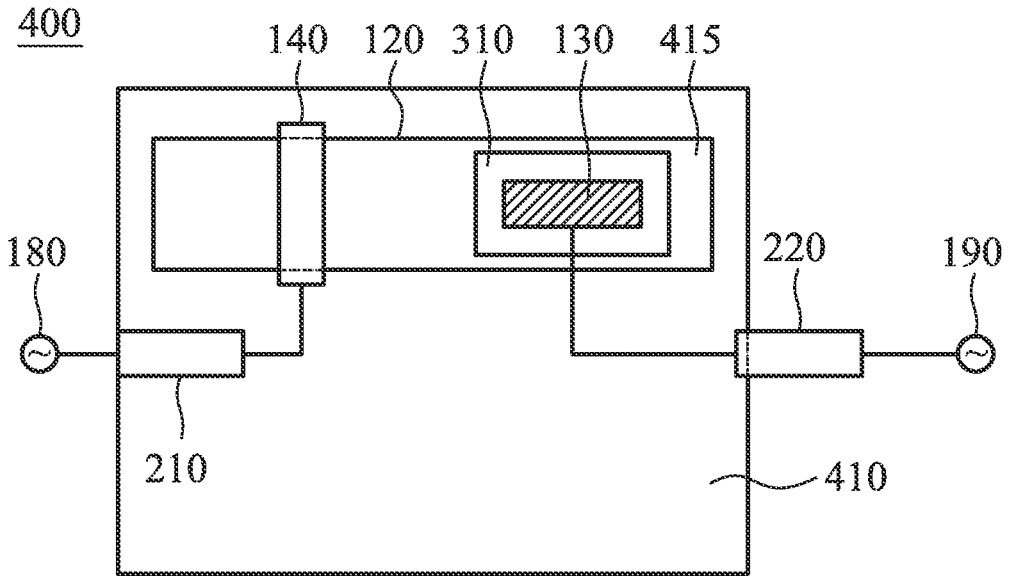
FIG. 4A is a top view for illustrating a mobile device according to an embodiment of the invention.
Figure 4B:
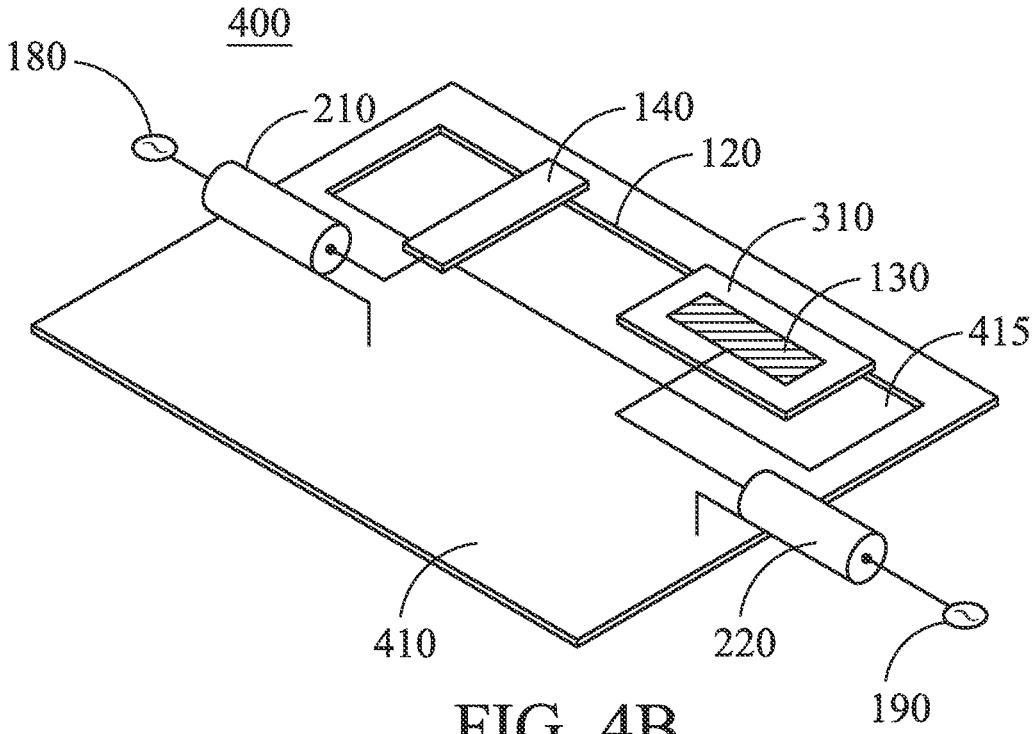
FIG. 4B is a pictorial drawing for illustrating a mobile device according to an embodiment of the invention.

FIG. 4A is a top view for illustrating a mobile device 400 according to an embodiment of the invention. FIG. 4B is a pictorial drawing for illustrating a mobile device 400 according to an embodiment of the invention. The mobile device 400 is similar to the mobile device 300 shown in FIGS. 3A and 3B. In the embodiment, a slot 415 of a metal body element 410 of the mobile device 400 substantially has a rectangular shape. As a matter of fact, the mobile device and the antenna structure of the invention may have similar performances, regardless of the shape of the slot of the metal body element.

Figure 5:
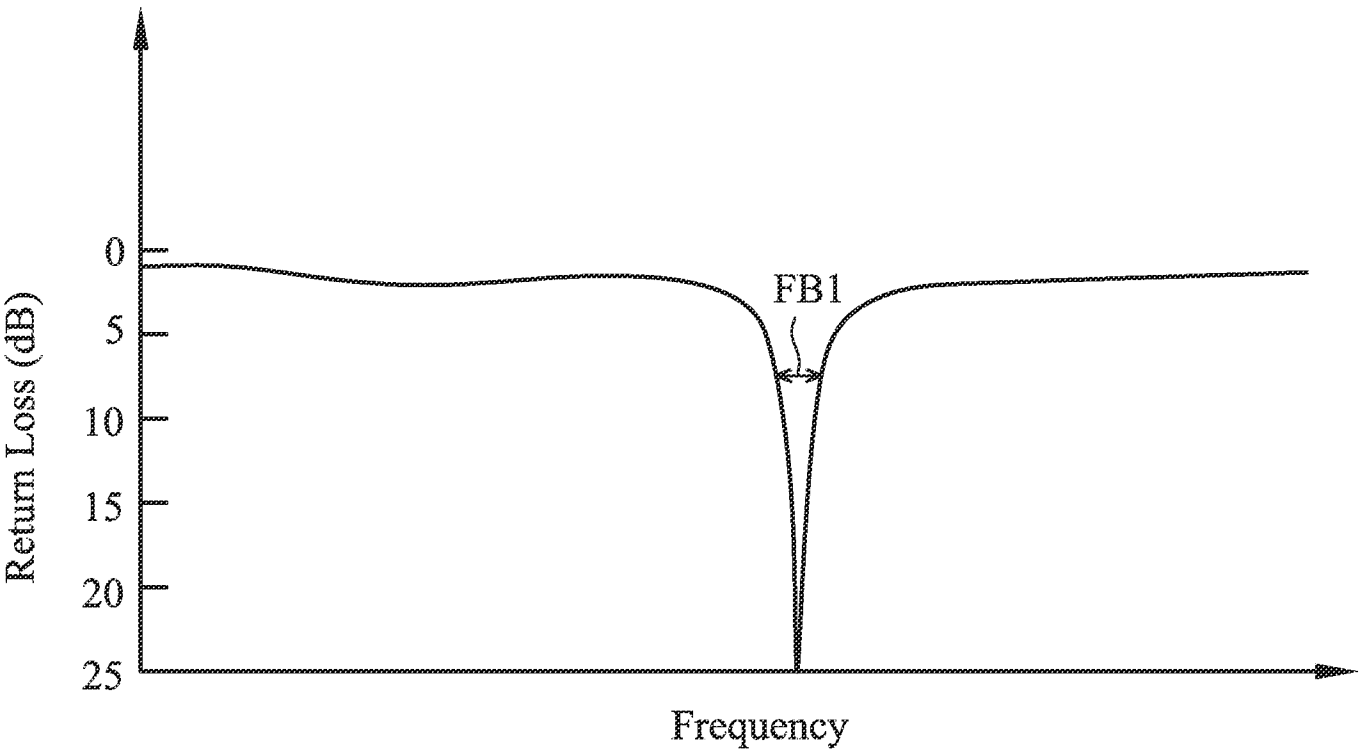
FIG. 5 is a diagram for illustrating return loss of a first antenna according to an embodiment of the invention.

FIG. 5 is a diagram for illustrating return loss of the first antenna 120 (slot antenna) according to an embodiment of the invention. The horizontal axis represents operation frequency, and the vertical axis represents the return loss. In a preferred embodiment, the first antenna 120 is excited to generate a first band FB1. The first band FB1 is approximately from 1570 MHz to 1580 MHz. Accordingly, the first antenna 120 substantially covers a GPS (Global Positioning System) band.

Figure 6:
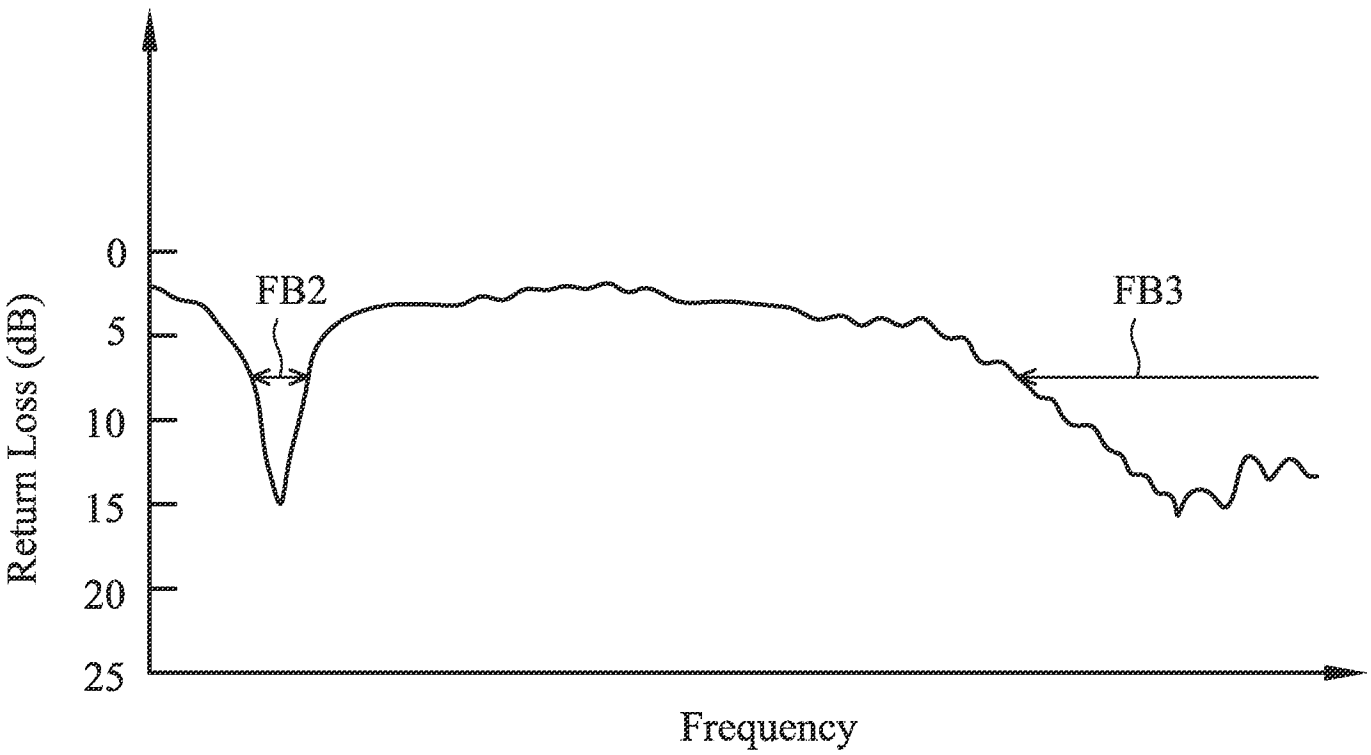
FIG. 6 is a diagram for illustrating return loss of a second antenna according to an embodiment of the invention.

FIG. 6 is a diagram for illustrating return loss of the second antenna 130 according to an embodiment of the invention. The horizontal axis represents operation frequency, and the vertical axis represents the return loss. In a preferred embodiment, the second antenna 130 is excited to generate a second band FB2 and a third band FB3. The second band FB2 is approximately from 2400 MHz to 2484 MHz, and the third band FB3 is approximately from 5150 MHz to 5850 MHz. Accordingly, the second antenna 130 substantially covers WLAN (Wireless Local Area Network) 2.4/5.2/5.8 GHz bands.

Refer back to FIGS. 1A, 1B, 2A, and 2B. In an embodiment, the element sizes of the mobile device 100 are as follows. The metal body element 110 has a length of about 300 mm, a width of about 200 mm, and a thickness of about 1 mm. The slot 115 has a total length (including a length of the narrow portion 116 and a length of the wide portion 117) of about 60 mm. The wide portion 117 of the slot 115 has a width of about 10 mm. The narrow portion 116 of the slot 115 has a width of about 5 mm. The second antenna 130 has a length of about 40 mm and a width of about 10 mm. The feeding element 140 has a length of about 10 mm and a width of about 1.5 mm. In addition, the first coaxial cable 210 has a length of about 200 mm and a diameter of about 1.6 mm (the diameter is of the sectional circle thereof). The size of the second coaxial cable 220 is similar to that of the first coaxial cable 210.

Note that the invention is not limited to the above. The above element sizes, element parameters and frequency ranges may be adjusted by a designer according to different desires. In addition, after being finely tuned, the mobile devices and the antenna structures therein in all embodiments of the invention have similar performances since they are designed in similar ways.

In the invention, the mobile device comprises at least two antennas. One antenna is a slot antenna, and another antenna is substantially disposed inside the slot antenna. The novel design not only effectively reduces the total size of the two antennas but also maintains good antenna efficiency thereof. Accordingly, the size of mobile devices may be further reduced.

To implement the invention, the design of the mobile device should meet the following requirements. A first requirement is related to the material. The body element by which the slot antenna is formed should be made of a conductive material (e.g., metal). A second requirement is related to the size. Since the resonant frequency of the slot antenna is determined by the antenna size, the slot should have a length of a corresponding wavelength of the resonant frequency. In an embodiment, the slot has a length of about 60 mm, which is approximately equal to 0.5 wavelength of the resonant frequency.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A mobile device, comprising:

a metal body element, being substantially a planar structure, and having a slot, wherein a first antenna is formed by the slot of the metal body element;

a feeding element, extending across the slot of the metal body element, and coupled to a first signal source; and a second antenna, substantially located inside the slot of the metal body element, and coupled to a second signal source, wherein the slot is used as a portion of a resonant structure of the second antenna in order to reduce a total size of the first antenna and the second antenna;

wherein the mobile device is a smart phone, a tablet computer, or a notebook computer;

wherein the metal body element is a portion of a housing of the mobile device;

wherein the second antenna has a vertical projection on the metal body element, and the vertical projection is completely inside the slot.

2. The mobile device as claimed in claim 1, further comprising:

a first coaxial cable, coupled between the feeding element and the first signal source.

3. The mobile device as claimed in claim 1, further comprising:

a second coaxial cable, coupled between the second antenna and the second signal source.

4. The mobile device as claimed in claim 1, further comprising:

a dielectric substrate, wherein the second antenna is disposed on the dielectric substrate.

5. The mobile device as claimed in claim 4, wherein the dielectric substrate and the metal body element are located on different planes.

6. The mobile device as claimed in claim 1, wherein the slot of the metal body element substantially has an L-shape.

7. The mobile device as claimed in claim 1, wherein the slot of the metal body element substantially has a rectangular shape.

8. The mobile device as claimed in claim 1, wherein the slot of the metal body element comprises a wide portion and a narrow portion, and the second antenna is substantially located inside the wide portion.

9. The mobile device as claimed in claim 1, wherein the first antenna is excited to generate a first band, and the first band is approximately from 1570 MHz to 1580 MHz.

10. The mobile device as claimed in claim 1, wherein the second antenna is excited to generate a second band and a third band, and the second band is approximately from 2400 MHz to 2484 MHz, and the third band is approximately from 5150 MHz to 5850 MHz.

* * * * *